US008147274B2

(12) United States Patent
Mizukami

(10) Patent No.: US 8,147,274 B2
(45) Date of Patent: Apr. 3, 2012

(54) CONNECTOR

(75) Inventor: Kazuhiro Mizukami, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 140 days.

(21) Appl. No.: 12/782,771

(22) Filed: May 19, 2010

(65) Prior Publication Data

US 2010/0297880 A1 Nov. 25, 2010

(30) Foreign Application Priority Data

May 20, 2009 (JP) ..... 2009-122494

(51) Int. Cl.
*H01R 13/648* (2006.01)

(52) U.S. Cl. ..... 439/607.07; 439/67

(58) Field of Classification Search ..... 439/67, 439/77, 607.05, 607.06, 607.07, 951; 174/260–262; 361/760, 763, 766
See application file for complete search history.

(56) References Cited

U.S. PATENT DOCUMENTS

| | | | | |
|---|---|---|---|---|
| 6,040,524 | A * | 3/2000 | Kobayashi et al. | 174/36 |
| 6,652,319 | B1 * | 11/2003 | Billman | 439/607.07 |
| 6,663,429 | B1 * | 12/2003 | Korsunsky et al. | 439/607.07 |
| 6,812,411 | B2 * | 11/2004 | Belau et al. | 174/261 |
| 7,044,793 | B2 * | 5/2006 | Takemasa | 439/607.07 |
| 7,044,794 | B2 * | 5/2006 | Consoli et al. | 439/607.07 |
| 7,326,858 | B2 * | 2/2008 | Lee et al. | 174/260 |
| 7,696,007 | B2 * | 4/2010 | Kikuchi et al. | 438/107 |

FOREIGN PATENT DOCUMENTS

JP 5-275139 10/1993

* cited by examiner

*Primary Examiner* — Thanh Tam Le
(74) *Attorney, Agent, or Firm* — IPUSA, PLLC

(57) ABSTRACT

A connector to be connected to a counterpart connector includes a circuit board having a ground layer, an insulating layer, and a first conductive layer successively stacked, the first conductive layer including a signal circuit and a ground circuit; and a second conductive layer electrically connecting the ground circuit and the ground layer, the second conductive layer being provided on a side of the counterpart connector in the ground circuit.

8 Claims, 19 Drawing Sheets

CONNECTOR

CROSS-REFERENCE TO RELATED APPLICATION

The present application is based upon and claims the benefit of priority of Japanese Patent Application No. 2009-122494, filed on May 20, 2009, the entire contents of which are incorporated herein by reference.

BACKGROUND OF THE INVENTION

1. Field of the Invention

The present invention relates generally to a connector that is connected to a counterpart connector by fitting. The present invention relates more particularly to a differential transmission connector.

2. Description of the Related Art

Data transmission systems include an ordinary transmission system and a differential transmission system. The ordinary transmission system employs an electric wire for each data item. The differential transmission system, using a pair of electric wires for each data item, simultaneously transmits a "+" signal to be transmitted and a "−" signal equal in magnitude and opposite in direction to the "+" signal. The differential transmission system, which has the advantage of being less susceptible to noise compared with the ordinary transmission system, is widely used in fields where signals are transmitted at high speed.

FIG. 1 is a schematic perspective view of a conventional differential transmission connector unit 1.

FIG. 2 is a schematic diagram illustrating a structure of the opposed faces of a plug connector 2 and a jack connector 3.

The differential transmission connector unit 1 includes the plug connector 2 and the jack connector 3. The plug connector 2 is mounted on a backplane (external board) 4. The jack connector 3 is mounted at an end of a daughterboard (external board) 5. The plug connector 2 and the jack connector 3 are connected so that the backplane 4 and the daughterboard 5 are electrically connected by the connector unit 1. (See, for example, Japanese Laid-Open Patent Application No. 5-275139.)

As illustrated in FIG. 1 and FIG. 2, the plug connector 2 includes multiple pairs of signal contacts (signal contact pairs) 252, multiple inverse L-letter shaped ground contacts 258 provided one for each signal contact pair, and a U-letter shaped insulative housing 8 that supports the signal contact pairs 252 and the ground contacts 258.

The signal contact pairs 252 are arranged in row directions (the X1 and the X2 direction) and in column directions (the Z1 and the Z2 direction) like a grid. Each of the signal contact pairs 252 includes a signal contact 254 and a signal contact 256 for transmitting positive and negative signals, respectively, having complementary waveforms in axial symmetry. The signal contacts 254 and 256 are arranged in the column directions. Each of the ground contacts 258 includes a horizontal plate part 258-1 and a vertical plate part 258-2 to cover a corresponding one of the signal contact pairs 252 on its Z1 side and X1 side. The horizontal plate parts 258-1 extend to the backside of the housing 8 to serve as terminal parts.

As illustrated in FIG. 1 and FIG. 2, the jack connector 3 includes an insulative housing 6, multiple modules 10, and multiple ground plates (shield plates) 111.

The insulative housing 6 includes openings 62-1 and 62-2 corresponding to the signal contacts 254 and 256, respectively, of the plug connector 2; and inverse L-letter shaped slits 62-3 corresponding to the ground contacts 258 of the plug connector 2.

The modules 10 are arranged in the row directions. Each of the modules 10 includes four signal contact pairs 152, which are arranged in the column directions. Each of the signal contact pairs 152 includes a signal contact 154 and a signal contact 156 for transmitting positive and negative signals, respectively, having complementary waveforms in axial symmetry. The signal contacts 154 and 156 are arranged in the column directions. The ground plates 111 are provided one between each adjacent two of the modules 10.

FIG. 3 is a schematic cross-sectional view of an electrically connected portion of the plug connector 2 and the jack connector 3.

The plug connector 2 and the jack connector 3 are electrically connected with the housing 8 being fit into the housing 6 to have the signal contacts 254 and 256 inserted into the housing 6 through the openings 62-1 and 62-2 to be in contact with the signal contacts 154 and 156, respectively.

At this point, the ground contacts 258 are inserted into the housing 6 through the corresponding slits 62-3 to have the vertical plate parts 258-2 and the horizontal plate parts 258-1 placed on the X1 side and the Z1 side, respectively, of the corresponding electrically connected portions of the signal contact pairs 252 and 152.

According to this configuration, each adjacent two of the connected signal contact pairs 152 and 252 are partitioned by a corresponding one of the ground plates 111 and a corresponding one of the ground contacts 258. Accordingly, it is possible to suppress crosstalk between adjacent signals and transmit signals at high speed.

SUMMARY OF THE INVENTION

According to one aspect of the present invention, a connector to be connected to a counterpart connector includes a circuit board having a ground layer, an insulating layer, and a first conductive layer successively stacked, the first conductive layer including a signal circuit and a ground circuit; and a second conductive layer electrically connecting the ground circuit and the ground layer, the second conductive layer being provided on a side of the counterpart connector in the ground circuit.

The object and advantages of the invention will be realized and attained by means of the elements and combinations particularly pointed out in the claims.

It is to be understood that both the foregoing general description and the following detailed description are exemplary and explanatory and not restrictive of the invention, as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

According to the above-described configuration of Japanese Laid-Open Patent Application No. 5-275139, when the plug connector 2 and the jack connector 3 are connected, the ground contacts 258 and the ground plates 111 are not in contact. Accordingly, the end sides of the ground contacts 258 and the end sides of the ground plates 111 become the dead ends (stubs) of transmission paths. Accordingly, ground is less effective against high-frequency signals, so that there may be the problem of varying ground potential.

According to one aspect of the present invention, a connector is provided whose ground is more effective against high-frequency signals.

A description is given below, with reference to the accompanying drawings, of an embodiment of the present invention.

Figure 4:
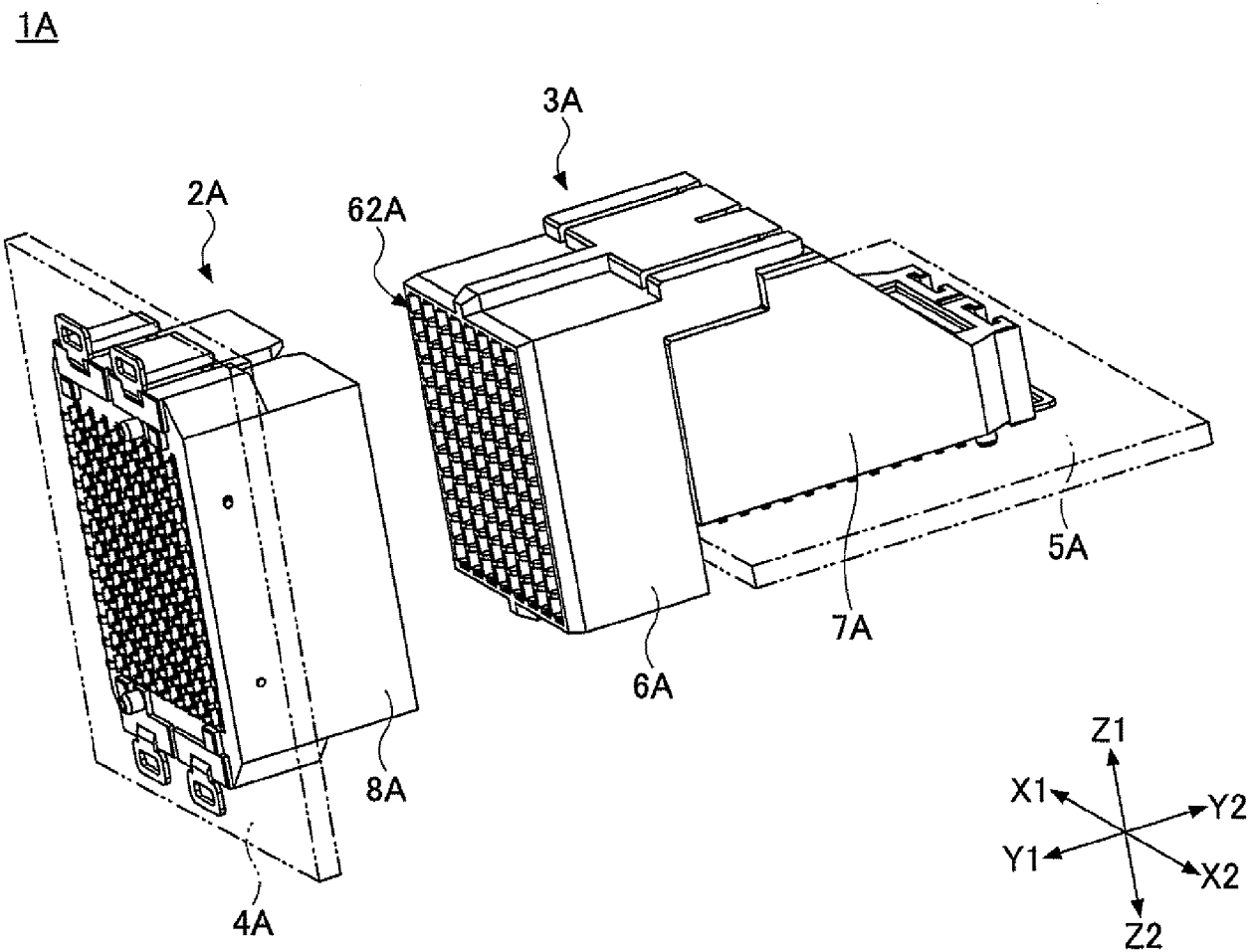
FIG. 4 is a perspective view of a differential transmission connector unit according to an embodiment of the present invention.

FIG. 4 is a perspective view of a differential transmission connector unit according to the embodiment of the present invention.

Referring to FIG. 4, a differential transmission connector unit 1A includes a plug connector 2A and a jack connector 3A. The plug connector 2A is mounted on a backplane (external board) 4A, and the jack connector 3A is mounted at an end of a daughterboard (external board) 5A. The plug connector 2A and the jack connector 3A are connected so that the backplane 4A and the daughterboard 5A are electrically connected by the connector unit 1A.

Figure 1:
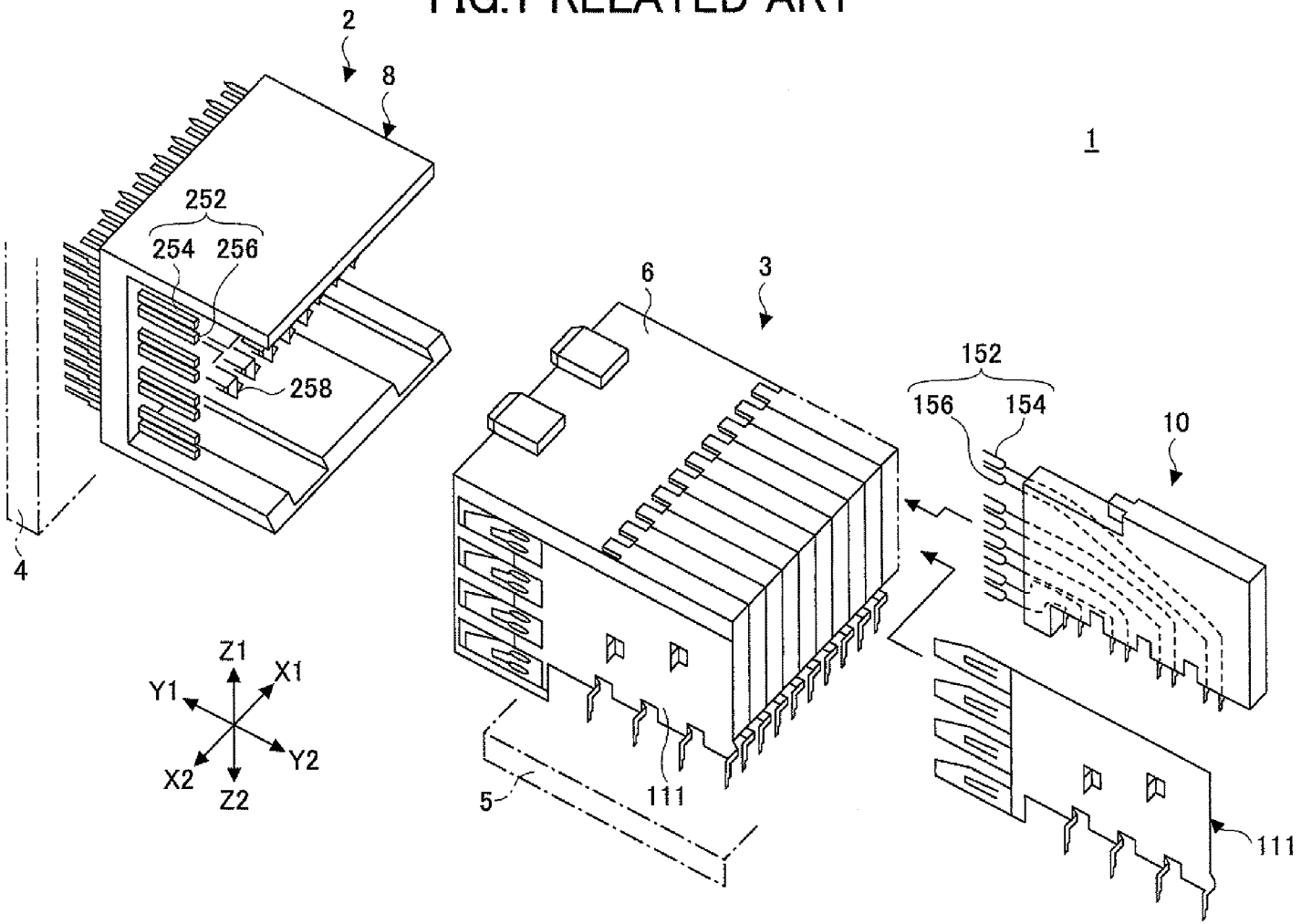
FIG.1 RELATED ART
FIG. 1 is a schematic perspective view of a conventional differential transmission connector unit.
Figure 2:
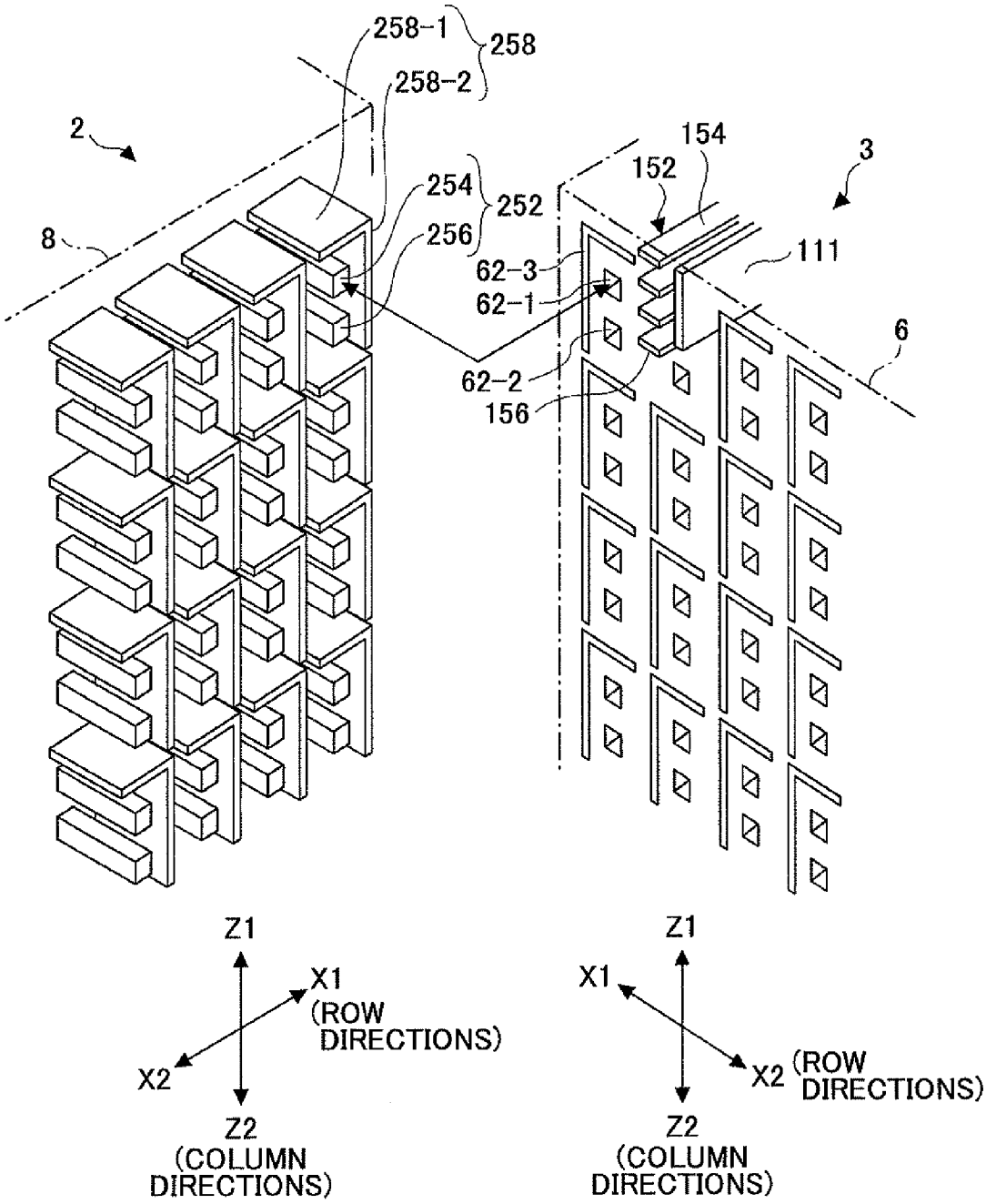
FIG.2 RELATED ART
FIG. 2 is a schematic diagram illustrating a structure of the opposed faces of a plug connector and a jack connector.
Figure 3:
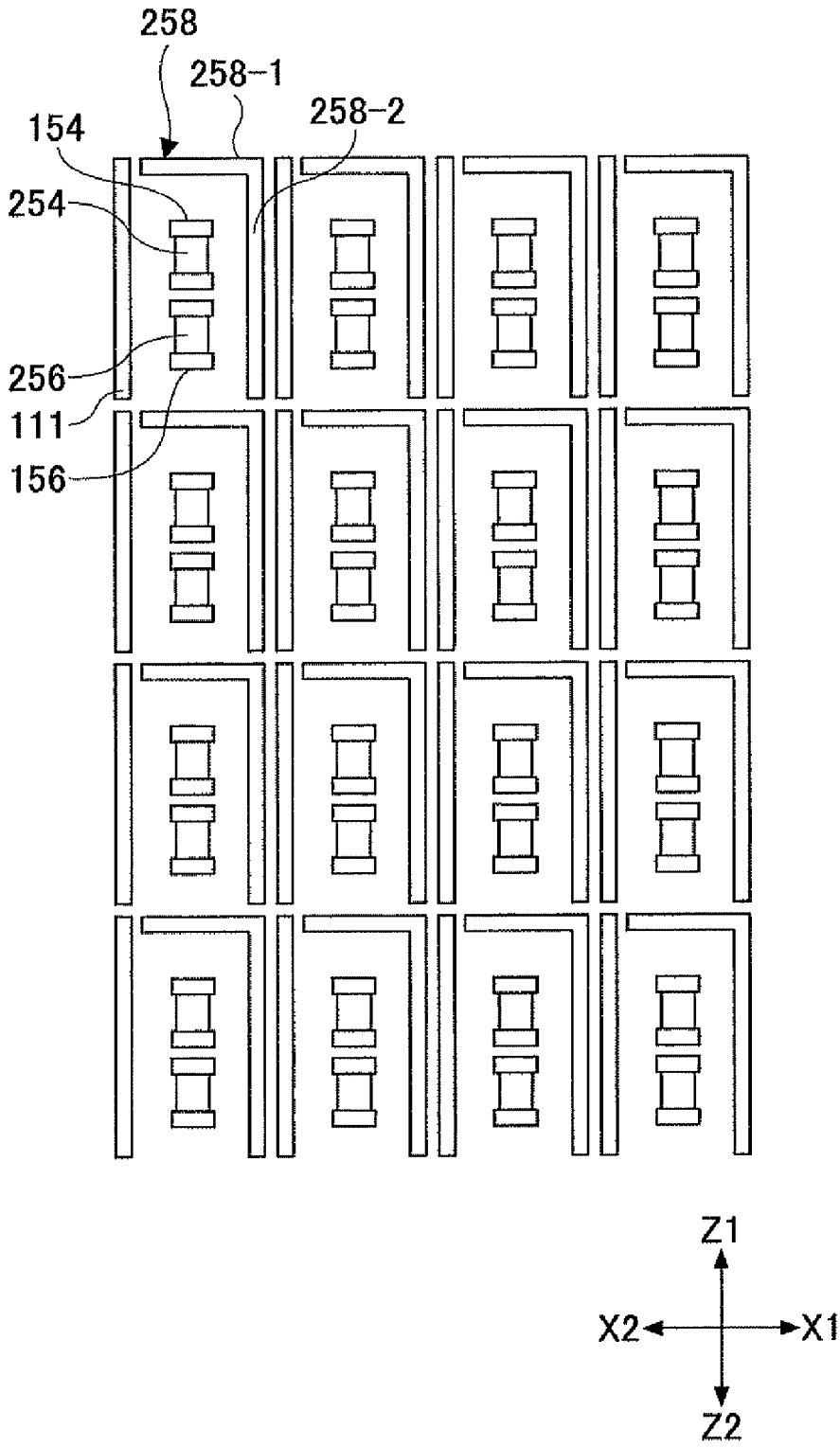
FIG.3 RELATED ART
FIG. 3 is a schematic cross-sectional view of an electrically connected portion of the plug connector and the jack connector.

Here, in the drawings of the embodiment, Y1-Y2 indicates the directions in which the plug connector 2A and the jack connector 3A are connected relative to each other, Z1-Z2 indicates the directions in which the jack connector 3A is mounted on the daughterboard 5A relative to each other, and X1-X2 indicates the directions perpendicular to the Y1 and the Y2 direction and the Z1 and the Z2 direction. In the drawings of the embodiment, elements or configurations corresponding to those illustrated in FIG. 1 through FIG. 3 are referred to by the same reference numerals with a suffix.

A description is given below first of a configuration of the jack connector 3A, then of a configuration of the plug connector 2A, and then of a connected portion of the plug connector 2A and the jack connector 3A.

Figure 5:
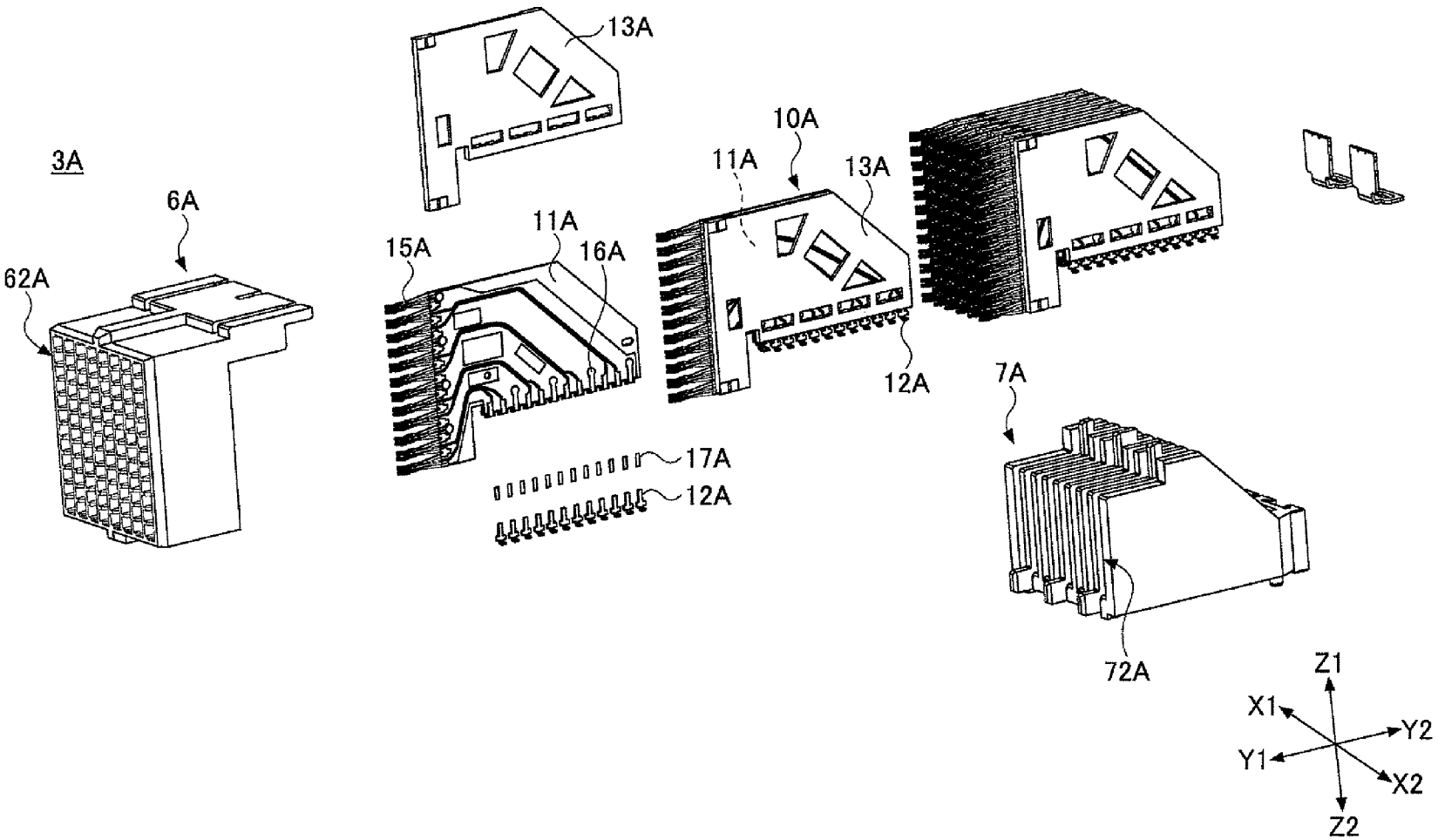
FIG. 5 is an exploded perspective view of a jack connector according to the embodiment of the present invention.

FIG. 5 is an exploded perspective view of the jack connector 3A.

The jack connector 3A includes a first insulative housing 6A, a second insulative housing 7A, and multiple modules 10A.

The first insulative housing 6A is configured to be fit to an insulative housing 8A (FIG. 4) of the plug connector 2A (a counterpart connector). Multiple openings 62A corresponding to multiple circuit boards 21A (FIG. 12) of the plug connector 2A are formed in the first insulative housing 6A. The first insulative housing 6A is fit into the insulative housing 8A so that the circuit boards 21A of the plug connector 2A are inserted into the first insulative housing 6A through the corresponding openings 62A to come into contact with corresponding circuit boards 11A of the jack connector 3A, thereby establishing an electrical connection between the jack connector 3A and the plug connector 2A.

The second insulative housing 7A is configured to support the first insulative housing 6A and also to support the multiple modules 10A so that the modules 10A are parallel to each other. For example, the second insulative housing 7A has multiple slits 72A. The slits 72A are arranged in the X1-X2 directions. The modules 10A are incorporated in the corresponding slits 72A on a one-to-one basis.

Each of the modules 10A includes the circuit board 11A with multiple connection pads 15A and multiple connection pads 16A; multiple leads 12A; multiple solder layers 17A; and an insulative spacer 13A. The leads 12A electrically connect the circuit board 11A to the daughterboard 5A. The solder layers 17A are disposed between the leads 12A and the corresponding connection pads 16A, so that the leads 12A are fixed to the corresponding connection pads 16A through the respective solder layers 17A. A description is given in detail below of the circuit board 11A.

Figure 6:
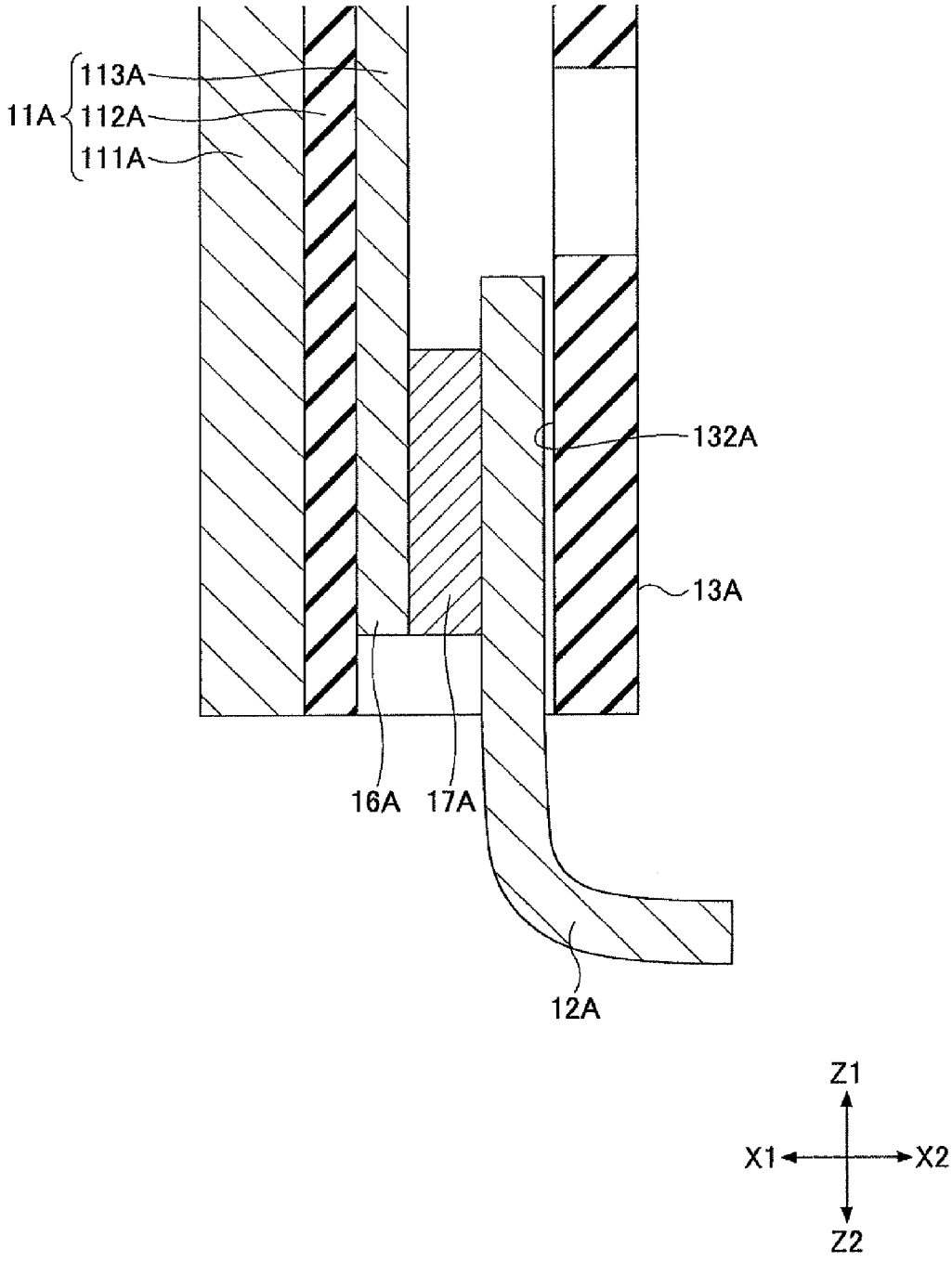
FIG. 6 is a cross-sectional view of part of a module, illustrating a connected portion of leads and a circuit board according to the embodiment of the present invention.

FIG. 6 is a cross-sectional view of part of the module 10A, illustrating a connected portion of the leads 12A and the circuit board 11A.

The spacer 13A is fixed onto one side of the circuit board 11A. The spacer 13A has multiple guide grooves 132A on its surface (X1-side surface) facing the circuit board 11A. The leads 12A are accommodated in the corresponding guide grooves 132A in such a manner as to be movable inside the guide grooves 132A when the solder layers 17A melt. Examples of the material of the solder layers 17A include a Sn—Bi alloy having a melting point of approximately 140° C. and a Sn—In alloy having a melting point of approximately 190° C.

Figure 7A:
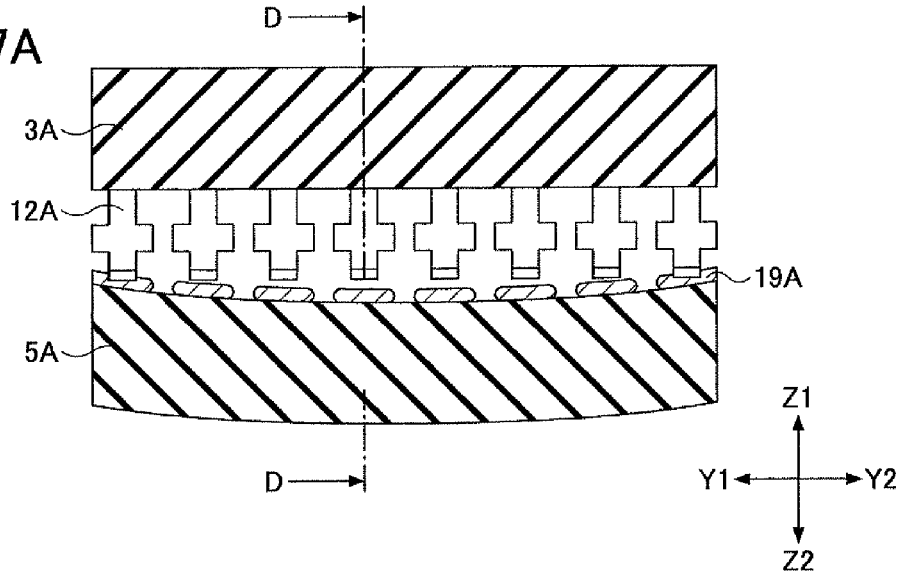
FIGS. 7A and 7B are a front-side cross-sectional view and a cross-sectional view taken along one-dot chain line D-D of FIG. 7A, respectively, of part of the jack connector and a daughterboard, illustrating placement of the jack connector on the daughterboard, according to the embodiment of the present invention.
Figure 7B:
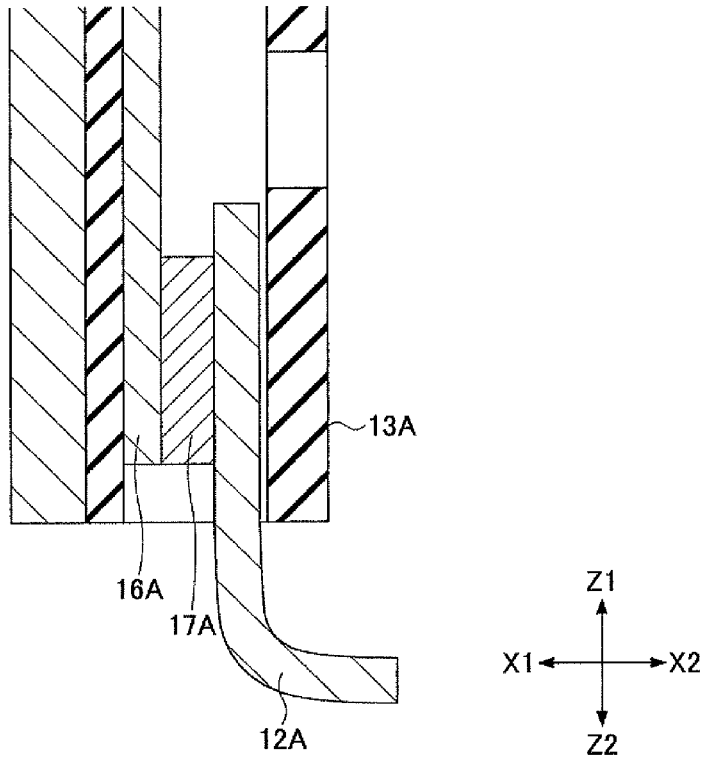

FIGS. 7A and 7B are a front-side cross-sectional view and a cross-sectional view taken along one-dot chain line D-D of FIG. 7A, respectively, of part of the jack connector 3A and the daughterboard 5A, illustrating placement of the jack connector 3A on the daughterboard 5A.

Referring to FIG. 7A, solder paste 19A for bonding the leads 12A is applied on the daughterboard 5A. In FIG. 7B, this solder paste 19A and the daughterboard 5A are omitted for convenience of graphical representation.

In the case illustrated in FIGS. 7A and 7B, there is a gap between some of the leads 12A and the solder paste 19A due to the (surface) warpage of the daughterboard 5A. A material higher in melting point than the solder layers 17A may be used for the solder paste 19A. Examples of the material of the solder paste 19A include a Sn—Ag—Cu alloy having a melting point of approximately 220° C.

Figure 8A:
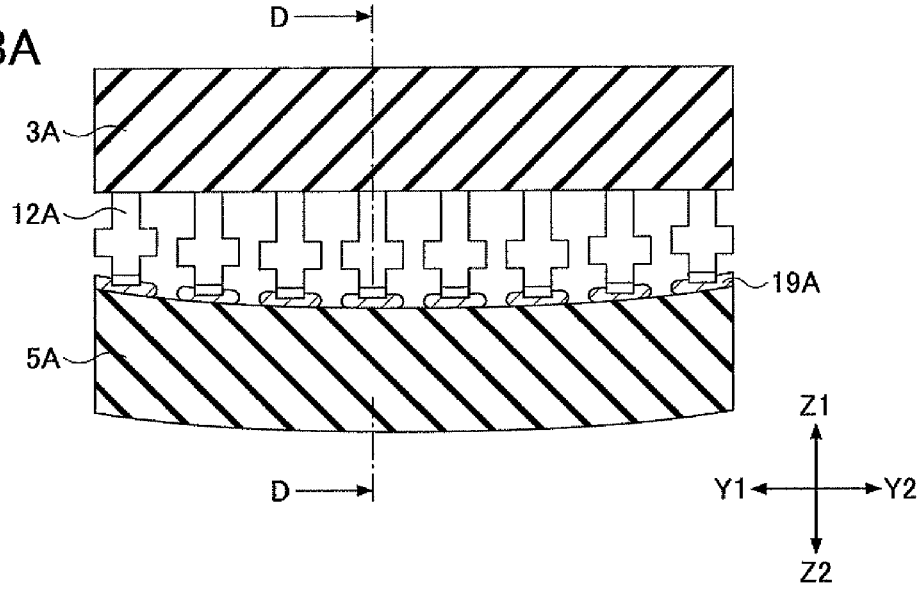
FIGS. 8A and 8B are a front-side cross-sectional view and a cross-sectional view taken along one-dot chain line D-D of FIG. 8A, respectively, of part of the jack connector and the daughterboard, illustrating a state of the structure of FIGS. 7A and 7B after heating, according to the embodiment of the present invention.
Figure 8B:
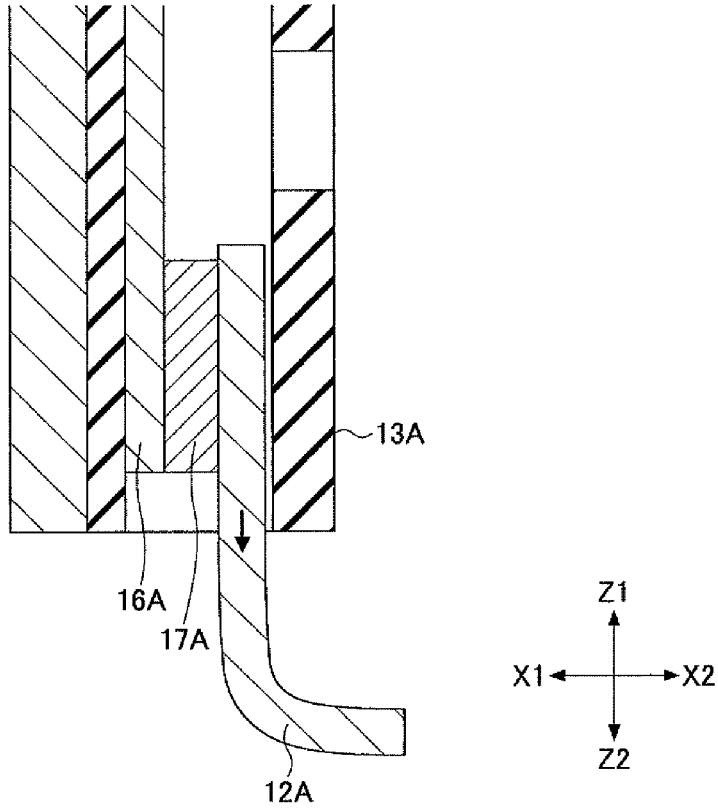

FIGS. 8A and 8B are a front-side cross-sectional view and a cross-sectional view taken along one-dot chain line D-D of FIG. 8A, respectively, of part of the jack connector 3A and the daughterboard 5A, illustrating a state of the structure of FIGS. 7A and 7B after heating. In FIG. 8B, the solder paste 19A and the daughterboard 5A are omitted for convenience of graphical representation.

When the solder layers 17A are caused to melt by application of heat, the leads 12A move inside the corresponding guide grooves 132A so as to absorb the (surface) warpage of the daughterboard 5A. As a result, it is possible to ensure the connection of the leads 12A to the daughterboard 5A after the heat treatment.

Figure 9A:
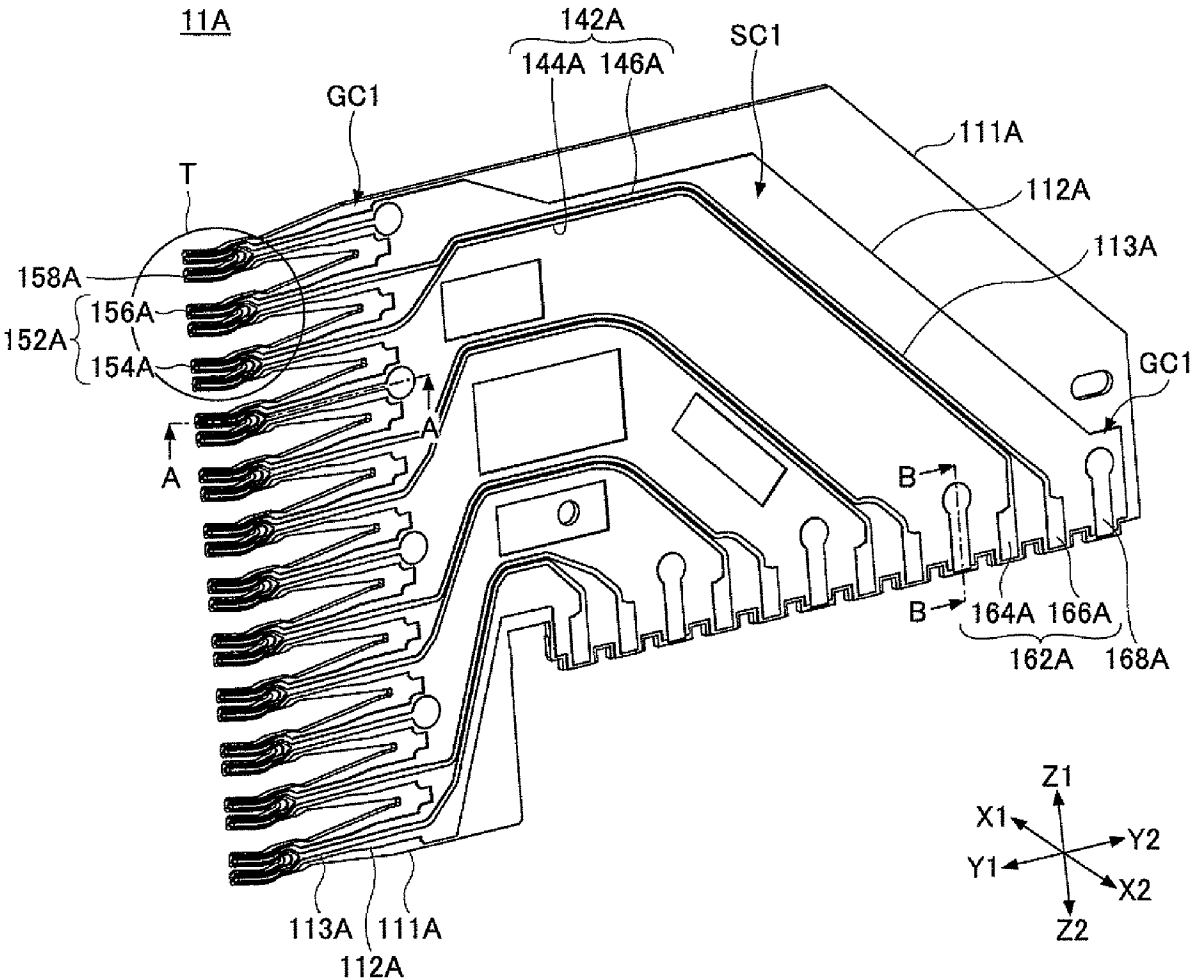
FIG. 9A is a perspective view of the circuit board, illustrating a configuration of the circuit board, according to the embodiment of the present invention.
Figure 9B:
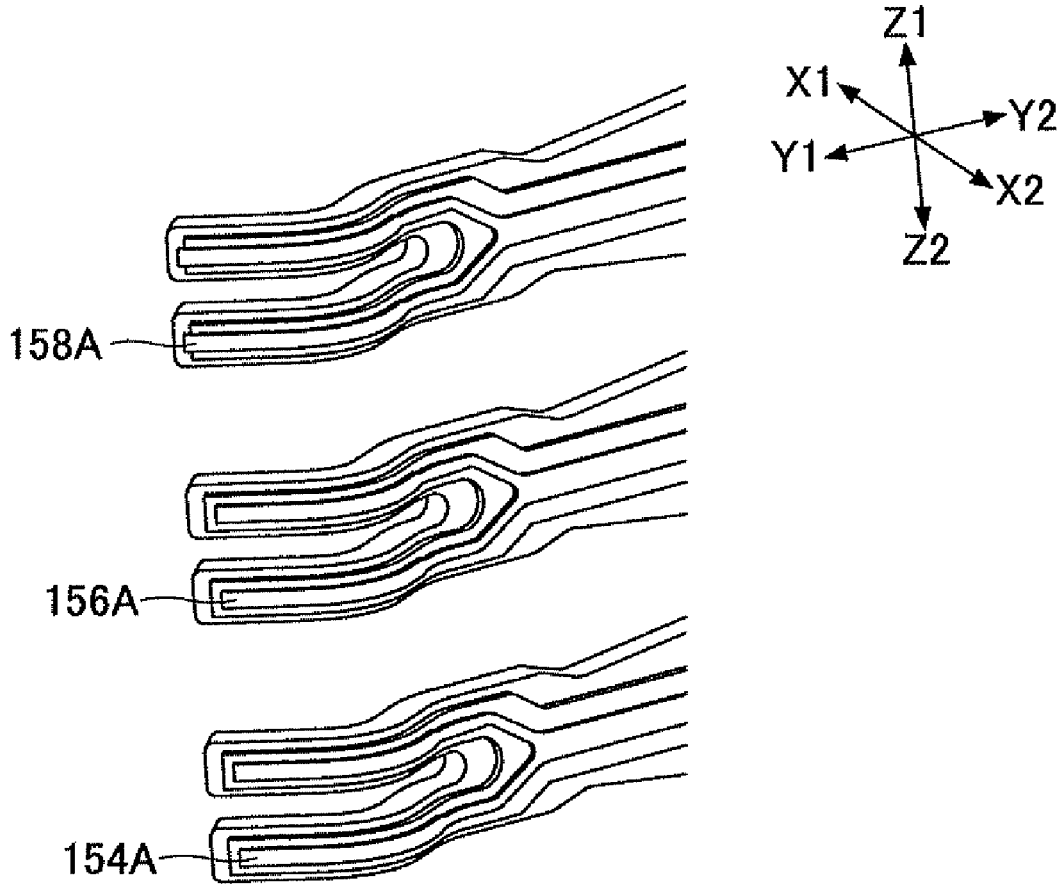
FIG. 9B is an enlarged view of an encircled region T of the circuit board of FIG. 9A according to the embodiment of the present invention.

FIG. 9A is a perspective view of the circuit board 11A, illustrating a configuration of the circuit board 11A. FIG. 9B is an enlarged view of an encircled region T of the circuit board 11A of FIG. 9A.

Referring to FIG. 9A as well as FIG. 6, the circuit board 11A includes a ground layer 111A, an insulating layer 112A, and an electrically conductive layer 113A, which are successively stacked.

The ground layer 111A and the insulating layer 112A cover substantially the entire conductive layer 113A. The ground layer 111A and the conductive layer 113A are basically insulated by the insulating layer 112A. A description is given in detail below of the conductive layer 113A.

The circuit boards 11A may be manufactured by a common method such as one using photolithography and etching.

FIGS. 10A through 10G are process diagrams illustrating a method of manufacturing the circuit boards 11A.

Figure 10A:
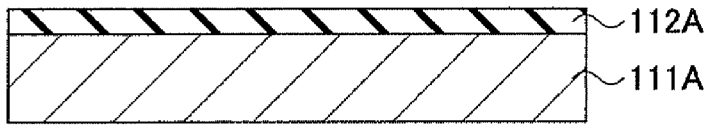
FIGS. 10A through 10G are process diagrams illustrating a method of manufacturing the circuit boards according to the embodiment of the present invention.

In the case illustrated in FIGS. 10A through 10G, first, as illustrated in FIG. 10A, photosensitive polyimide ink is applied and dried on the ground layer 111A, which may be a phosphor bronze metal plate, so that the insulating layer 112A is formed on the ground layer 111A.

Figure 10B:
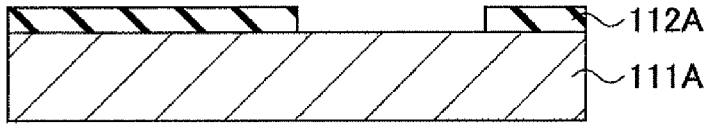

Next, as illustrated in FIG. 10B, the insulating layer 112A is exposed to light and developed using a photomask (not graphically illustrated).

Figure 10C:
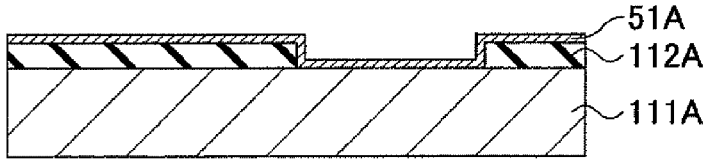

Next, as illustrated in FIG. 10C, a Ni—W film 51A is deposited (stacked) on the structure of FIG. 10B by sputtering.

Figure 10D:
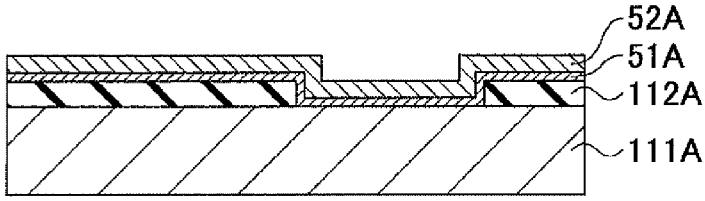

Next, as illustrated in FIG. 10D, a Cu film 52A is deposited (stacked) on the Ni—W film 51A by electroplating.

Figure 10E:
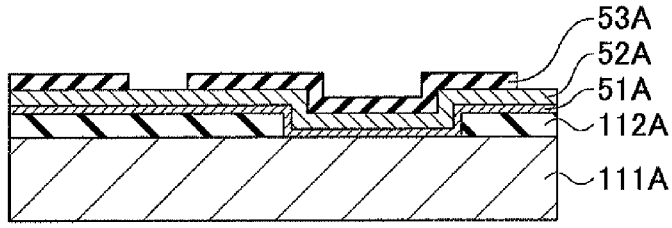

Next, as illustrated in FIG. 10E, a photoresist pattern 53A is formed on the Cu film 52A.

Figure 10F:
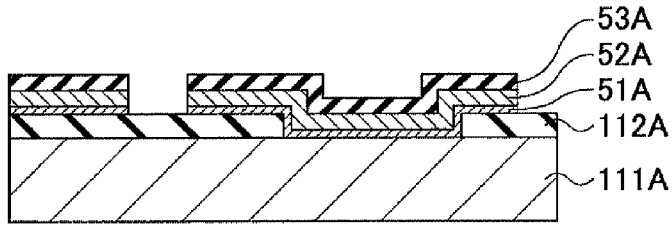

Next, as illustrated in FIG. 10F, the Cu film 52A and the Ni—W film 51A are etched using the photoresist pattern 53A.

Figure 10G:
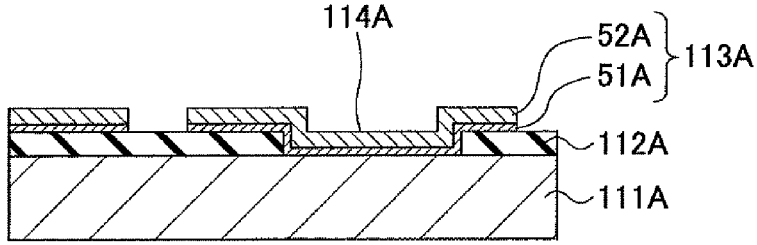

Next, as illustrated in FIG. 10G, the photoresist pattern 53A is removed, so that the conductive layer 113A and a below-described conductive layer 114A are formed of the Cu film 52A and the Ni—W film 51A.

According to this embodiment, the circuit board 11A has a three-layer structure of the insulating layer 112A and the conductive layer 113A successively stacked on the ground layer (metal plate) 111A. Alternatively, the circuit board 11A may have another three-layer structure of the insulating layer 112A, the ground layer 111A formed on one of the principal surfaces of the insulating layer 112A, and the conductive layer 113A formed on the other one of the principal surfaces of the insulating layer 112A. In either case, by forming the conductive layer 113A by a method using photolithography and etching, it is possible to microfabricate the conductive layer 113A and to reduce its thickness, so that it is possible to reduce the size of the jack connector 3A.

Referring back to FIG. 9A, the conductive layer 113A includes a signal circuit SC1 that comes into contact with a signal circuit SC2 (FIG. 15A) of the plug connector 2A; and a ground circuit GC1 that comes into contact with a ground circuit GC2 (FIG. 15A) of the plug connector 2A.

The signal circuit SC1 includes four signal connection pad pairs 152A aligned in the Z1-Z2 directions on the plug connector 2A side (on the Y1 side); four signal connection pad pairs 162A aligned in the Y1-Y2 directions on the daughterboard 5A side (on the Z2 side); and four signal interconnect pairs 142A that connect the signal connection pad pairs 152A and 162A.

Each of the signal connection pad pairs 152A includes a pair of signal connection pads 154A and 156A for transmitting positive and negative signals, respectively, having complementary waveforms in axial symmetry. The signal connection pads 154A and 156A are aligned in the Z1-Z2 directions. Each of the signal connection pads 154A and 156A bifurcates at the end to have a two-pronged fork shape.

Each of the signal connection pad pairs 162A includes a pair of signal connection pads 164A and 166A for transmitting positive and negative signals, respectively, having complementary waveforms in axial symmetry. The signal connection pads 164A and 166A are aligned in the Y1-Y2 directions. Each of the signal connection pads 164A and 166A has a rectangular shape.

Each of the signal interconnect pairs 142A includes a pair of signal interconnects 144A and 146A for transmitting positive and negative signals, respectively, having complementary waveforms in axial symmetry. The signal interconnects 144A connect the Y1-side signal connection pads 154A and the Z2-side signal connection pads 164A. The signal interconnects 146A connect the Y1-side signal connection pads 156A and the Z2-side signal connection pads 166A.

On the other hand, the ground circuit GC1 includes four ground connection pads 158A aligned in the Z1-Z2 directions on the plug connector 2A side (on the Y1 side); and four ground connection pads 168A aligned in the Y1-Y2 directions on the daughterboard 5A side (on the Z2 side).

The ground connection pads 158A are provided one for each of the signal connection pad pairs 152A on its Z1 (or Z2) side, so as to alternate with the signal connection pad pairs 152A. Each of the ground connection pads 158A has substantially the same shape as the signal connection pads 154A and 156A, bifurcating at the end to have a two-pronged fork shape.

The ground connection pads 168A are provided one for each of the signal connection pad pairs 162A on its Y2 (or Y1) side, so as to alternate with the signal connection pad pairs 162A, Each of the ground connection pads 168A has substantially the same rectangular shape as the signal connection pads 164A and 166A.

In the description of this embodiment, the signal connection pads 154A and 156A and the ground connection pads 158A, which are provided on the plug connector 2A side (on the Y1 side), may be collectively referred to as the "connection pads 15A" (FIG. 5) in the case of not distinguishing them in particular. Further, the signal connection pads 164A and 166A and the ground connection pads 168A, which are provided on the daughterboard 5A side (on the Z2 side), may be collectively referred to as the "connection pads 16A" (FIG. 5) in the case of not distinguishing them in particular.

Figure 11A:
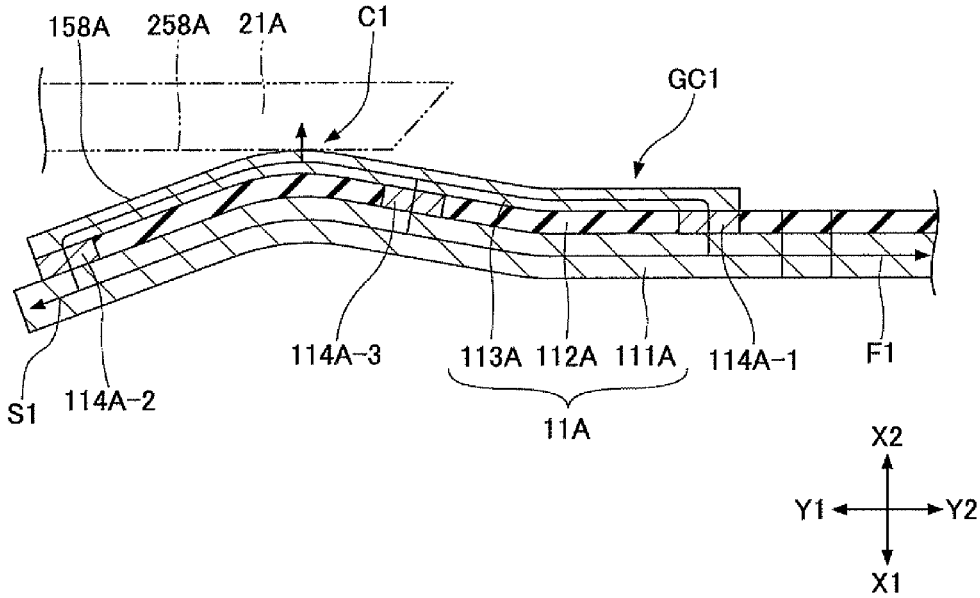
FIGS. 11A and 11B are cross-sectional views of the circuit board taken along one-dot chain line A-A and one-dot chain line B-B, respectively, of FIG. 9A, illustrating a transmission path of a ground circuit and a ground layer, according to the embodiment of the present invention.
Figure 11B:
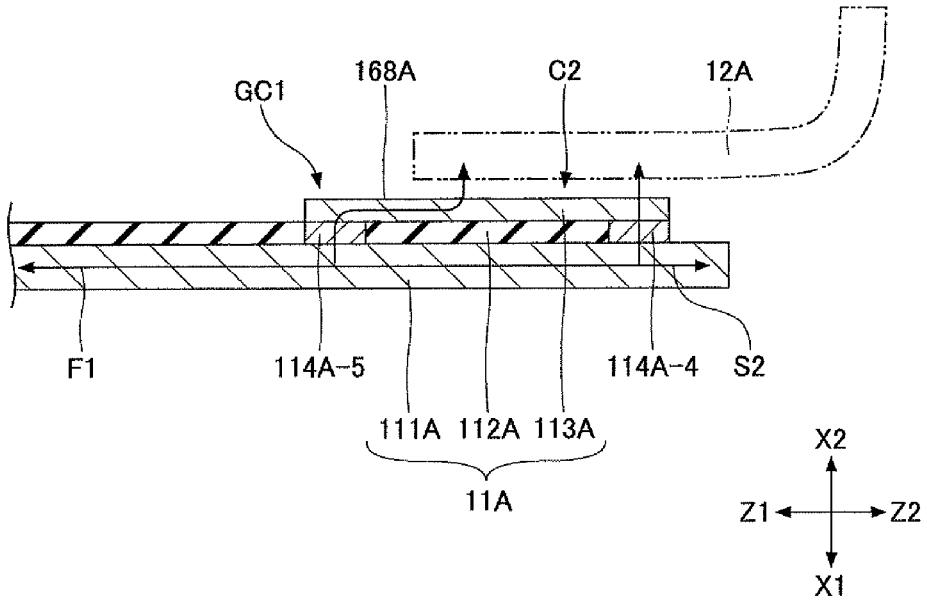

FIGS. 11A and 11B are cross-sectional views of the circuit board 11A taken along one-dot chain line A-A and one-dot chain line B-B, respectively, of FIG. 9A, illustrating a transmission path of the ground circuit GC1 and the ground layer 111A. In FIGS. 11A and 11B, arrow F1 indicates a transmission path and arrows S1 and S2 indicate the dead-end portions (stubs) of the transmission path F1.

A conductive layer is provided between the ground circuit GC1 and the ground layer 111A. For example, in the case illustrated in FIGS. 11A and 11B, conductive layers 114A-1, 114A-2, 114A-3, 114A-4, and 114A-5 are provided between the ground circuit GC1 and the ground layer 111A. The conductive layers 114A-1 through 114A-5 may be collectively referred to as the "conductive layer 114A."

As illustrated in FIGS. 11A and 11B, the conductive layer 114A may be provided at the outer edge or periphery of the insulating layer 112A as the conductive layers 114A-2 and 114-A4 and through the insulating layer 112A as the conductive layers 114A-1, 114A-3, and 114A-5.

The conductive layer 114A is provided on the plug connector 2A side (on the Y1 side) in the ground circuit GC1. For example, as illustrated in FIG. 11A, the conductive layer 114A-2 is provided on the plug connector 2A side (on the Y1 side or at the Y1 end) on the ground connection pad 158A. This makes it possible to narrow (reduce) the stub S1 of the transmission path F1 on the plug connector 2A side (on the Y1 side). As a result, it is possible to suppress a variation in ground potential even in high-speed transmission, so that it is possible to make ground more effective against high-frequency signals.

Figure 15B:
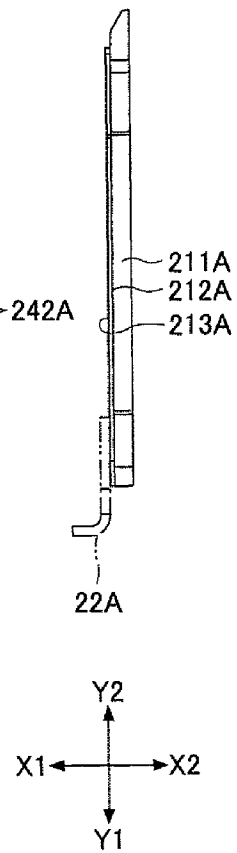
FIGS. 15A and 15B are a front (X1-side) view and a side (Z1-side) view, respectively, of a circuit board according to the embodiment of the present invention.
Figure 15A:
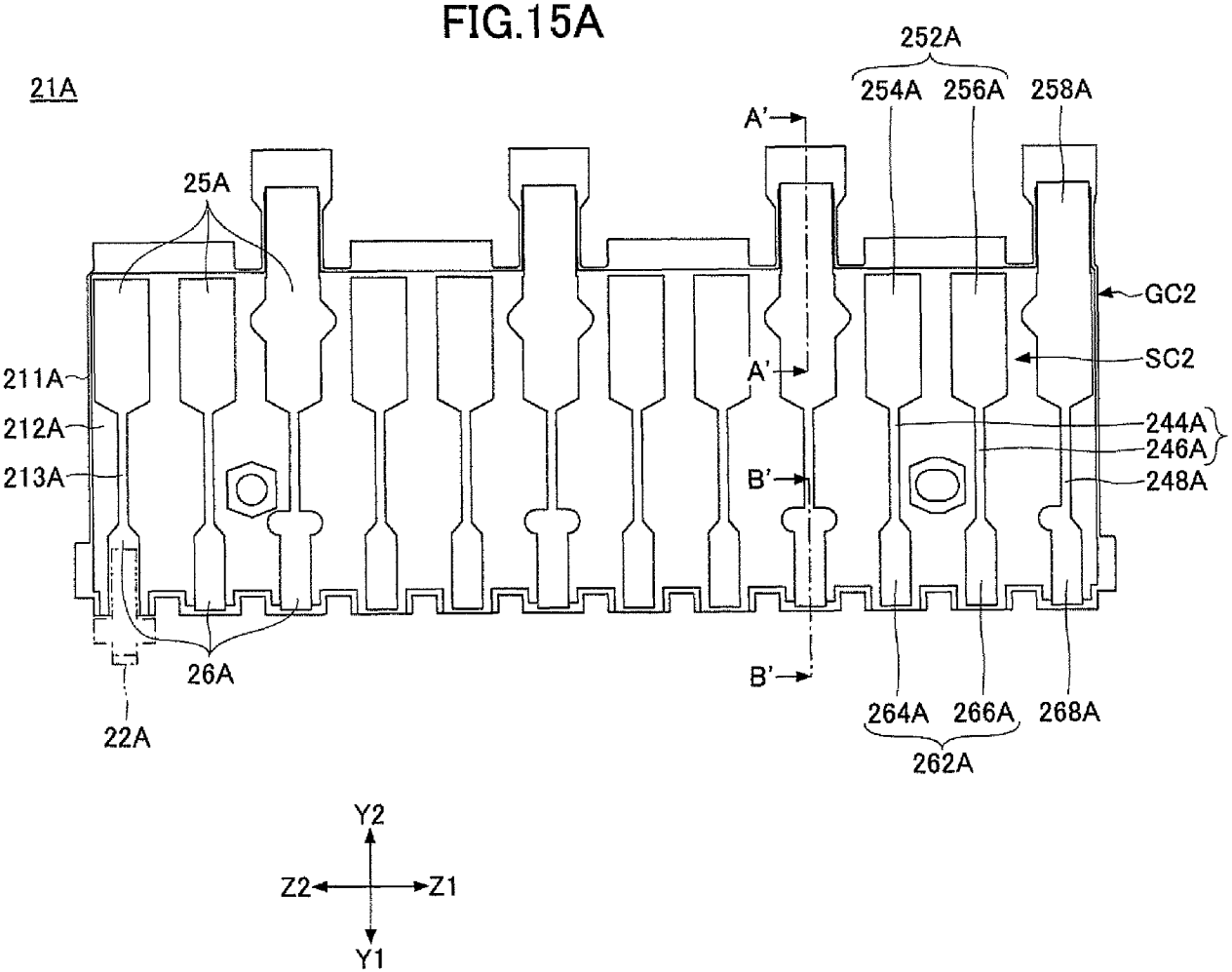

The conductive layer 114A may be further provided in or around part of the ground circuit GC1 which part comes into contact with the counterpart ground circuit GC2 (the ground circuit GC2 of the plug connector 2A) (FIG. 15A). For example, as illustrated in FIG. 11A, the conductive layer 114A-3 is provided near a contact part C1 of the ground connection pad 158A which comes into contact with a counterpart one of ground connection pads 258A (see also FIG. 15A) of the circuit board 21A. This shortens the transmission path between the contact part C1 (the plug connector 2A) and the ground layer 111A. As a result, it is possible to suppress a variation in ground potential even in high-speed transmission, so that it is possible to make ground more effective against high-frequency signals.

As illustrated in FIG. 11A, the conductive layer 114A-3 may be provided near the contact part C1 and across the contact part C1 (on the opposite [Y2] side of the contact part C1) from the plug connector 2A. This allows the transmission direction of the shortest transmission path between the contact part C1 (the plug connector 2A) and the ground layer 111A to be a forward direction (unidirectional), so that it is possible to improve transmission characteristics.

Further, the conductive layer 114A may be provided on the daughterboard 5A side (the Z2 side) in the ground circuit GC1. For example, as illustrated in FIG. 11B, the conductive layer 114A-4 may be provided on the daughterboard 5A side (on the Z2 side or at the Z2 end) on the ground connection pad 168A. This makes it possible to narrow (reduce) the stub S2 of the transmission path F1 on the daughterboard 5A side (on the Z2 side). As a result, it is possible to make ground more effective against high-frequency signals.

Further, the conductive layer 114A may be provided in or around part of the ground circuit GC1 which part comes into contact with the leads 12A. For example, as illustrated in FIG. 11B, the conductive layer 114A-5 is provided near a contact part C2 of the ground connection pad 168A which comes into contact with the corresponding lead 12A. As a result, it is possible to increase the number of shortest transmission paths between the contact part C2 (leads 12A) and the ground layer 111A, so that it is possible to make ground more effective against high-frequency signals.

Next, a description is given of a configuration of the plug connector 2A.

Figure 12:
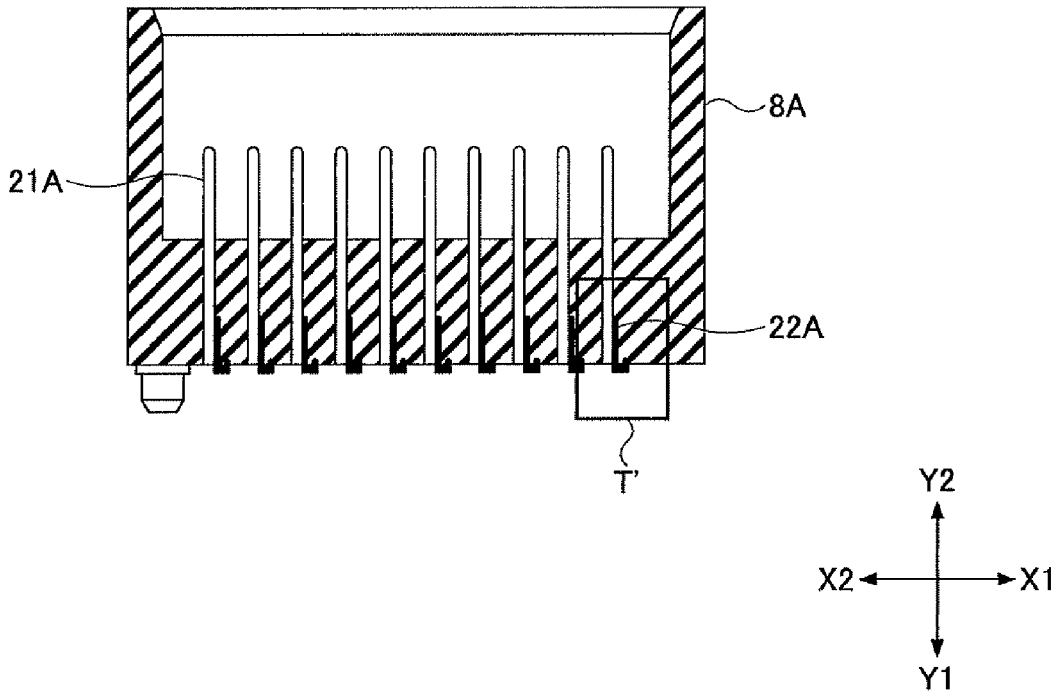
FIG. 12 is a schematic cross-sectional view of a plug connector, illustrating a configuration of the plug connector, according to the embodiment of the present invention.

FIG. 12 is a schematic cross-sectional view of the plug connector 2A, illustrating a configuration of the plug connector 2A.

Figure 13:
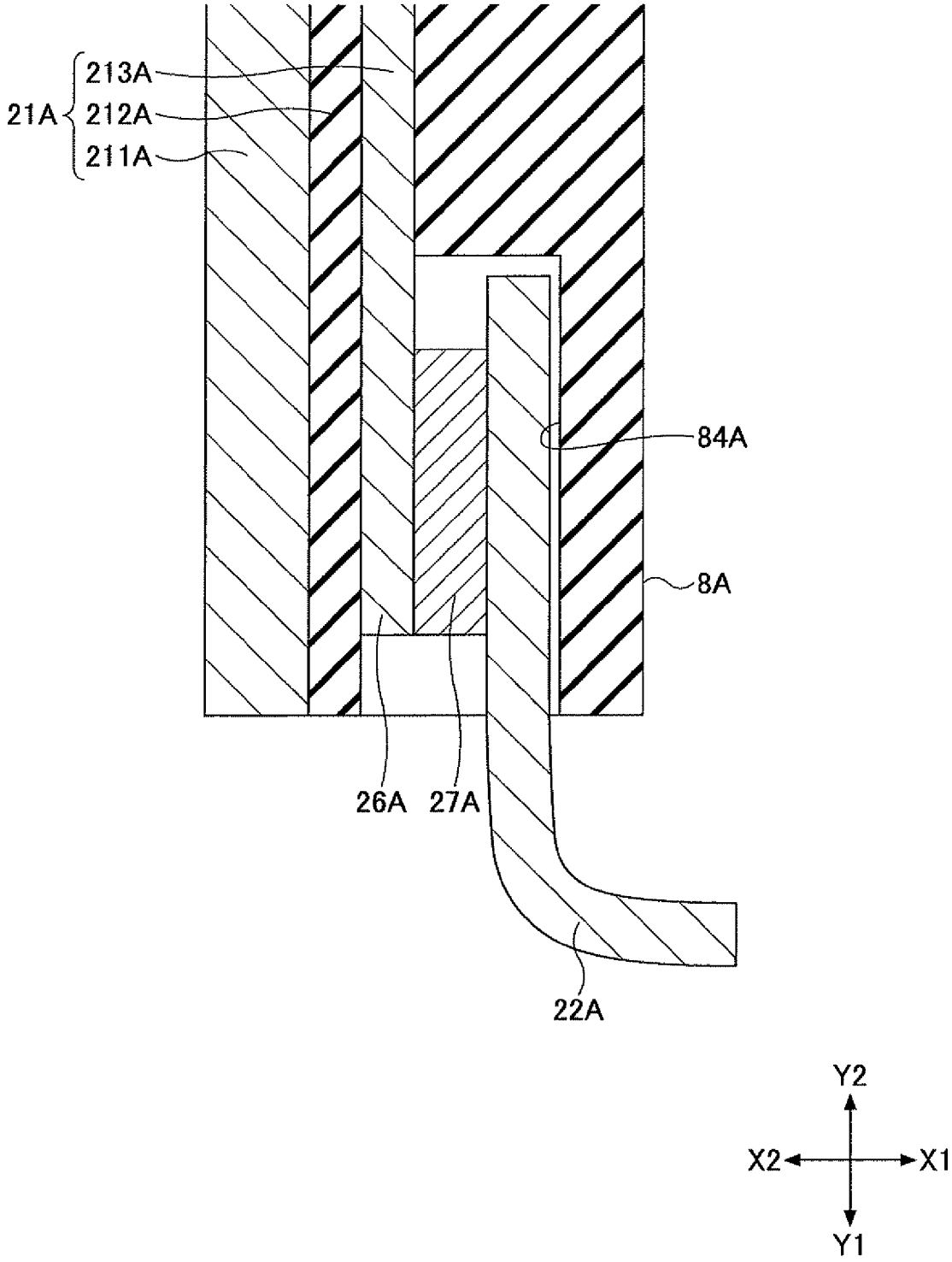
FIG. 13 is an enlarged view of a boxed region T' of the plug connector of FIG. 12 according to the embodiment of the present invention.

FIG. 13 is an enlarged view of a boxed region T' of the plug connector 2A of FIG. 12.

Figure 14:
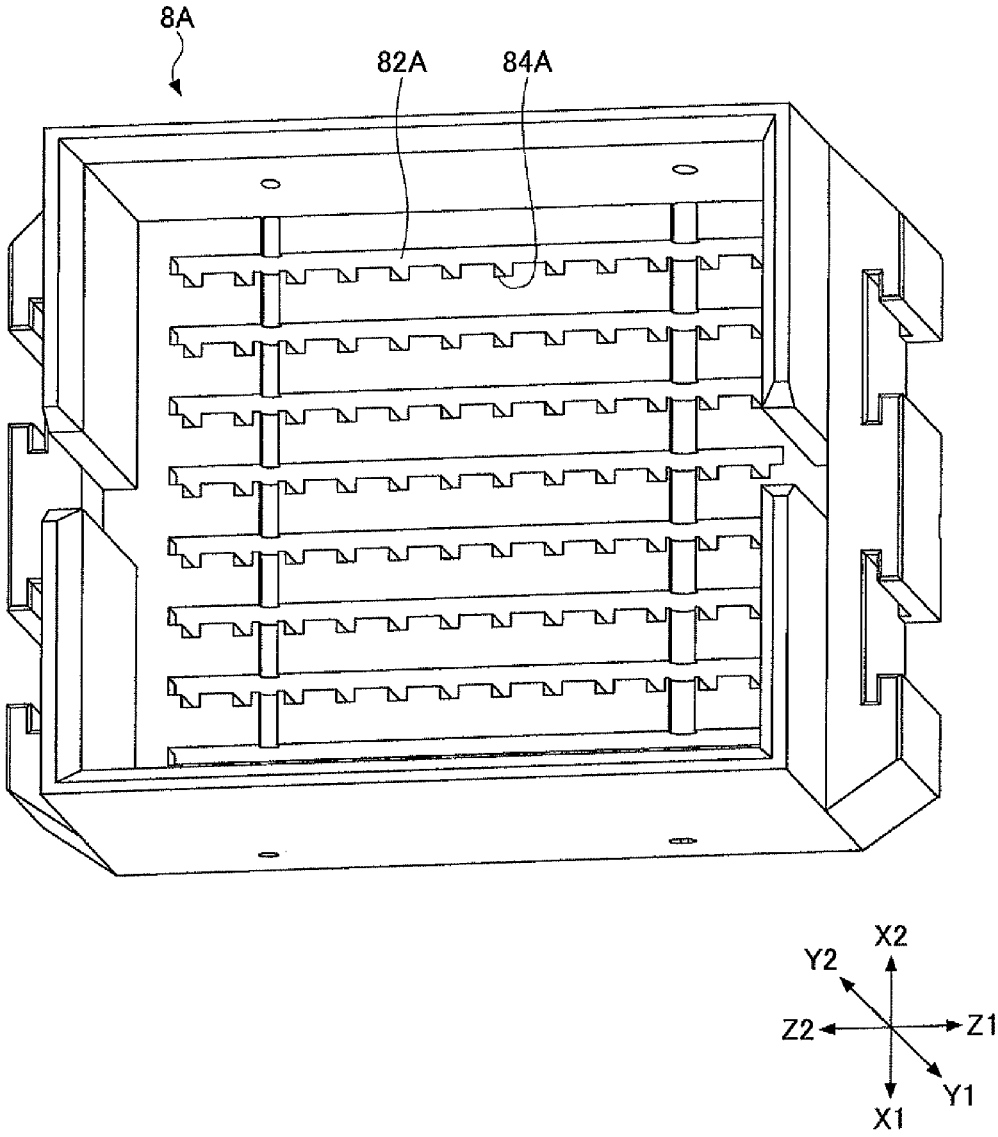
FIG. 14 is a perspective view of an insulative housing of the plug connector according to the embodiment of the present invention.

FIG. 14 is a perspective view of the insulative housing 8A of the plug connector 2A.

FIGS. 15A and 15B are a front (X1-side) view and a side (Z1-side) view, respectively, of the circuit board 21A.

The plug connector 2A includes the insulative housing 8A; the multiple circuit boards 21A each having multiple connection pads 25A and multiple connection pads 26A; and multiple leads 22A.

Referring to FIG. 12 through FIG. 14, in the insulative housing 8A, multiple slits 82A are formed in alignment in the X1-X2 directions, and the circuit boards 21A are incorporated into the corresponding slits 82A on a one-to-one basis to be parallel to each other.

The leads 22A electrically connect the circuit boards 21A to the backplane 4A. Multiple solder layers 27A are disposed between the leads 22A and the corresponding connection pads 26A, so that the leads 22A are fixed to the corresponding connection pads 26A through the respective solder layers 27A.

As illustrated in FIG. 12 through FIG. 14, the insulative housing 8A has multiple guide grooves 84A provided on one of the opposed (inside) surfaces of each of the slits 82A. The leads 22A are accommodated in the corresponding guide grooves 84A in such a manner as to be movable inside the guide grooves 84A when the corresponding solder layers 27A melt. Accordingly, like in the case of the jack connector 3A (a counterpart connector), when the solder layers 27A are caused to melt by application of heat, the leads 22A move inside the corresponding guide grooves 84A so as to absorb the (surface) warpage of the backplane 4A. As a result, it is possible to ensure the connection of the leads 22A to the backplane 4A after the heat treatment.

As illustrated in FIG. 13 and FIGS. 15A and 15B, the circuit board 21A has a three-layer structure of a ground layer 211A, an insulating layer 212A, and an electrically conductive layer 213A, which are successively stacked.

The ground layer 211A and the insulating layer 212A cover substantially the entire conductive layer 213A. The ground layer 211A and the conductive layer 213A are basically insulated by the insulating layer 212A. A description is given in detail below of the conductive layer 213A.

Like the circuit boards 11A, the circuit boards 21A may be manufactured by a common method such as one using photolithography and etching.

Referring to FIG. 15A, the conductive layer 213A includes a signal circuit SC2 that comes into contact with the signal circuit SC1 (FIG. 9A) of the jack connector 3A; and a ground circuit GC2 that comes into contact with the ground circuit GC1 (FIG. 9A) of the jack connector 3A.

The signal circuit SC2 includes four signal connection pad pairs 252A aligned in the Z1-Z2 directions on the jack connector 3A side (on the Y2 side); four signal connection pad pairs 262A aligned in the Z1-Z2 directions on the backplane 4A side (on the Y1 side); and four signal interconnect pairs 242A that connect the signal connection pad pairs 252A and 262A.

Each of the signal connection pad pairs 252A includes a pair of signal connection pads 254A and 256A for transmitting positive and negative signals, respectively, having complementary waveforms in axial symmetry. The signal connection pads 254A and 256A are aligned in the Z1-Z2 directions. Each of the signal connection pads 254A and 256A has a rectangular shape.

Each of the signal connection pad pairs 262A includes a pair of signal connection pads 264A and 266A for transmitting positive and negative signals, respectively, having complementary waveforms in axial symmetry. The signal connection pads 264A and 266A are aligned in the Z1-Z2 directions. Each of the signal connection pads 264A and 266A has a rectangular shape.

Each of the signal interconnect pairs 242A includes a pair of signal interconnects 244A and 246A for transmitting positive and negative signals, respectively, having complementary waveforms in axial symmetry. The signal interconnects 244A connect the Y2-side signal connection pads 254A and the Y1-side signal connection pads 264A. The signal interconnects 246A connect the Y2-side signal connection pads 256A and the Y1-side signal connection pads 266A.

On the other hand, the ground circuit GC2 includes the four ground connection pads 258A aligned in the Z1-Z2 directions on the jack connector 3A side (on the Y2 side); four ground connection pads 268A aligned in the Z1-Z2 directions on the backplane 4A side (on the Y1 side); and four ground interconnects 248A that connect the ground connection pads 258A and 268A.

The ground connection pads 258A are provided one for each of the signal connection pad pairs 252A on its Z1 (or Z2) side, so as to alternate with the signal connection pad pairs 252A. Each of the ground connection pads 258A has a rectangular shape to project further toward the jack connector 3A side (in the Y2 direction) than the signal connection pads 254A and 256A.

The ground connection pads 268A are provided one for each of the signal connection pad pairs 262A on its Z1 (or Z2) side, so as to alternate with the signal connection pad pairs 262A. Each of the ground connection pads 268A has substantially the same rectangular shape as the signal connection pads 264A and 266A.

In the description of this embodiment, the signal connection pads 254A and 256A and the ground connection pads 258A, which are provided on the jack connector 3A side (on the Y2 side), may be collectively referred to as the "connection pads 25A" in the case of not distinguishing them in particular. Further, the signal connection pads 264A and 266A and the ground connection pads 268A, which are provided on the backplane 4A side (on the Y1 side), may be collectively referred to as the "connection pads 26A" in the case of not distinguishing them in particular.

Figure 16A:
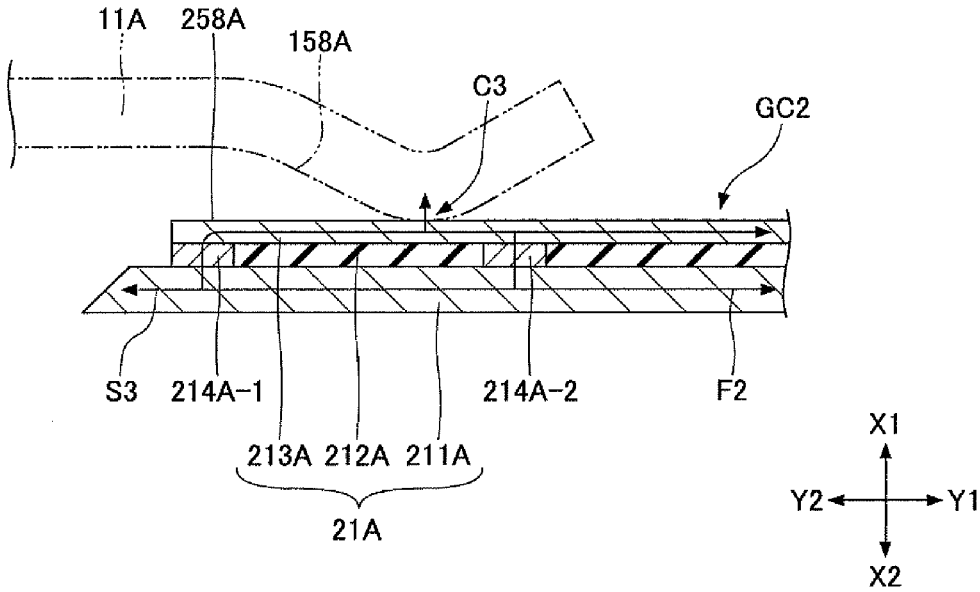
FIGS. 16A and 16B are cross-sectional views of the circuit board taken along one-dot chain line A'-A' and one-dot chain line B'-B', respectively, of FIG. 15A, illustrating a transmission path of a ground circuit and a ground layer, according to the embodiment of the present invention.
Figure 16B:
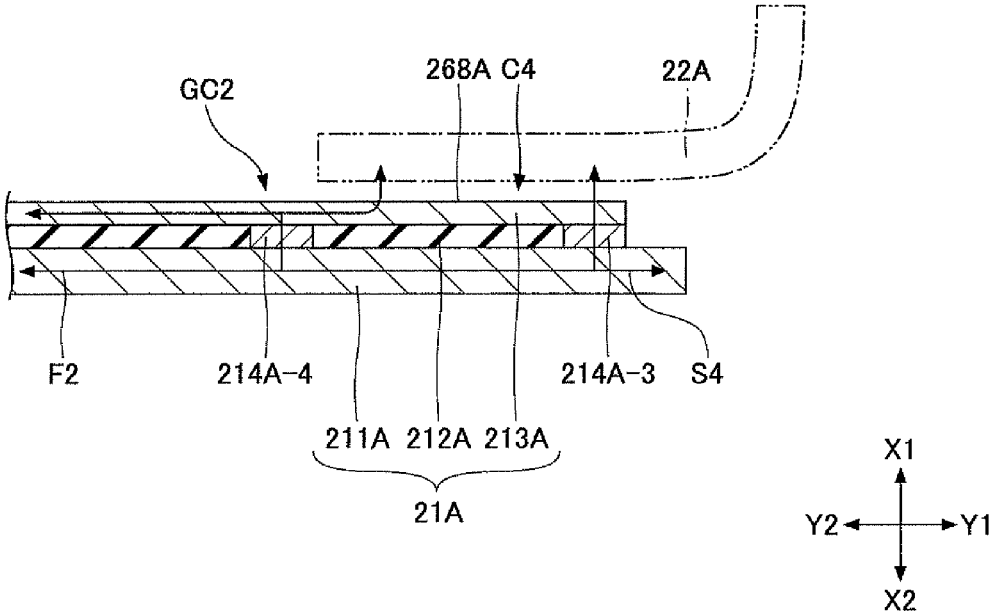

FIGS. 16A and 16B are cross-sectional views of the circuit board 21A taken along one-dot chain line A'-A' and one-dot chain line B'-B', respectively, of FIG. 15A, illustrating a transmission path of the ground circuit GC2 and the ground layer 211A. In FIGS. 16A and 16B, arrow F2 indicates a transmission path and arrows S3 and S4 indicate the dead-end portions (stubs) of the transmission path F2.

A conductive layer is provided between the ground circuit GC2 and the ground layer 211A. For example, in the case illustrated in FIGS. 16A and 16B, conductive layers 214A-1, 214A-2, 214A-3, and 214A-4 are provided between the ground circuit GC2 and the ground layer 211A. The conductive layers 214A-1 through 214A-4 may be collectively referred to as "conductive layer 214A."

As illustrated in FIGS. 16A and 16B, the conductive layer 214A may be provided at the outer edge or periphery of the insulating layer 212A as the conductive layers 214A-1 and 214-A3 and through the insulating layer 212A as the conductive layers 114A-2 and 214A-4.

The conductive layer 214A is provided on the jack connector 3A side (on the Y2 side) in the ground circuit GC2. For example, as illustrated in FIG. 16A, the conductive layer 214A-1 is provided on the jack connector 3A side (on the Y2 side or at the Y2 end) on the ground connection pad 258A. This makes it possible to narrow (reduce) the stub S3 of the transmission path F2 on the jack connector 3A side (on the Y2 side). As a result, it is possible to suppress a variation in ground potential even in high-speed transmission, so that it is possible to make ground more effective against high-frequency signals.

The conductive layer 214A may be further provided in or around part of the ground circuit GC2 which part comes into contact with the counterpart ground circuit GC1 (the ground circuit GC1 of the jack connector 3A) (FIG. 9A). For example, as illustrated in FIG. 16A, the conductive layer 214A-2 is provided near a contact part C3 of the ground connection pad 258A which comes into contact with the corresponding ground connection pad 158A of the circuit board 11A. This shortens the transmission path between the contact part C3 (the jack connector 3A) and the ground layer 211A. As a result, it is possible to suppress a variation in ground potential even in high-speed transmission, so that it is possible to make ground more effective against high-frequency signals.

As illustrated in FIG. 16A, the conductive layer 214A-2 may be provided near the contact part C3 and across the contact part C3 (on the opposite [Y1] side of the contact part C3) from the jack connector 3A. This allows the transmission direction of the shortest transmission path between the contact part C3 (the jack connector 3A) and the ground layer 211A to be a forward direction (unidirectional), so that it is possible to improve transmission characteristics.

Further, the conductive layer 214A may be provided on the backplane 4A side (the Y1 side) in the ground circuit GC2. For example, as illustrated in FIG. 16B, the conductive layer 214A-3 may be provided on the backplane 4A side (on the Y1 side or at the Y1 end) on the ground connection pad 268A. This makes it possible to narrow (reduce) the stub S4 of the transmission path F2 on the backplane 4A side (on the Y1 side). As a result, it is possible to make ground more effective against high-frequency signals.

Further, the conductive layer 214A may be provided in or around part of the ground circuit GC2 which part comes into contact with the leads 22A. For example, as illustrated in FIG. 16B, the conductive layer 214A-4 is provided near a contact part C4 of the ground connection pad 268A which comes into contact with the corresponding lead 22A. As a result, it is possible to increase the number of shortest transmission paths between the contact part C4 (leads 22A) and the ground layer 211A, so that it is possible to make ground more effective against high-frequency signals.

Figure 17:
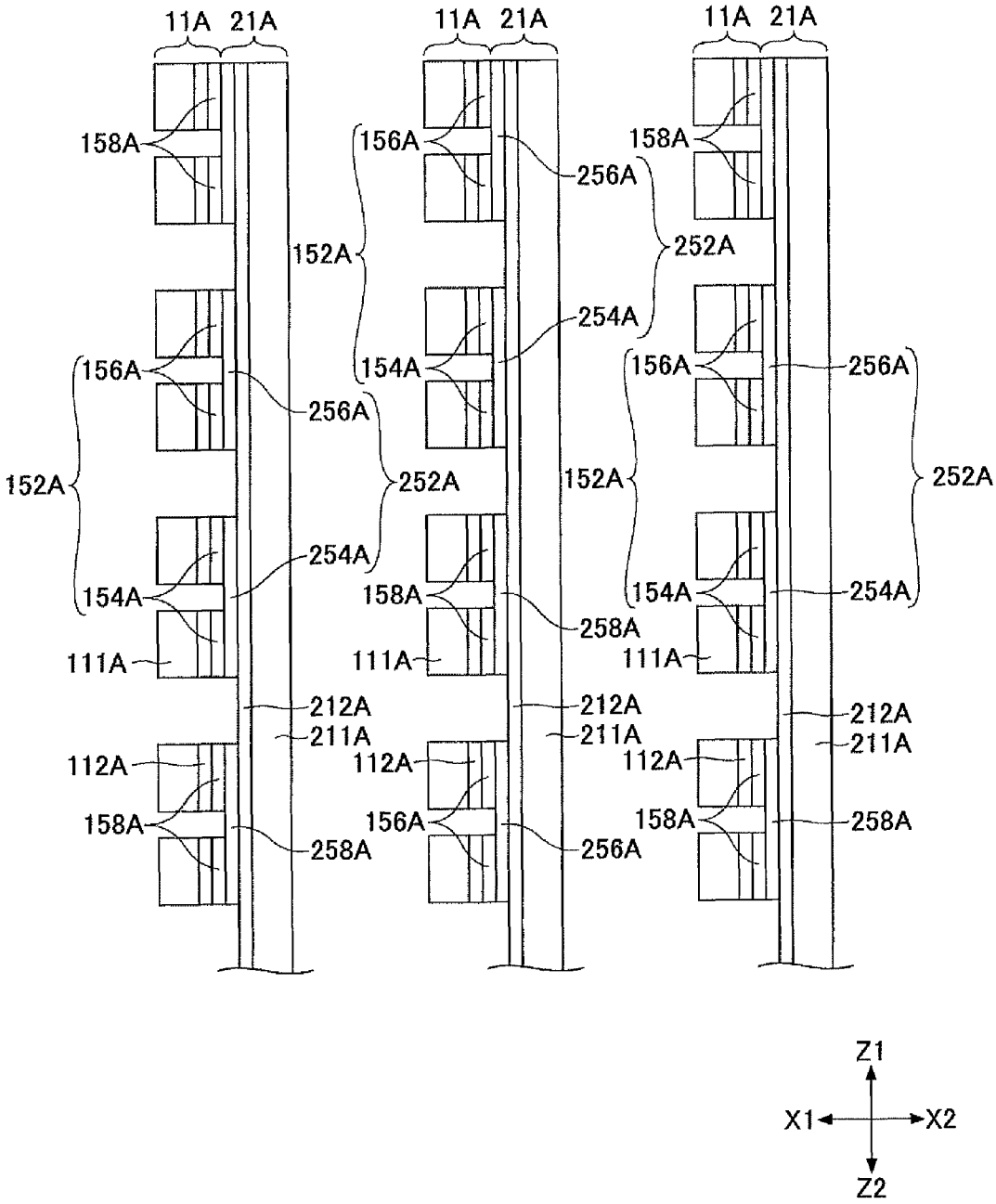
FIG. 17 is a schematic cross-sectional view of a connected portion of the plug connector and the jack connector according to the embodiment of the present invention.

Next, a description is given, with reference to FIG. 17, of a connected portion of the plug connector 2A and the jack connector 3A.

FIG. 17 is a schematic cross-sectional view of a connected portion of the plug connector 2A and the jack connector 3A.

The connection pads 25A of the plug connector 2A come into contact with the corresponding connection pads 15A of the jack connector 3A so that the plug connector 2A and the jack connector 3A are electrically connected.

At this point, the signal connection pads 154A come into contact with the signal connection pads 254A, the signal connection pads 156A come into contact with the signal connection pads 256A, and the ground connection pads 158A come into contact with the ground connection pads 258A. Adjacent signal pairs (adjacent electrically connected portions of the signal connection pad pairs 152A and 252A) in the Z1-Z2 directions have the ground connection pads 158A and 258A placed therebetween, and adjacent signal pairs in the X1-X2 directions have the ground layers 111A and 211A placed therebetween. This makes it possible to suppress crosstalk between adjacent signal pairs, so that it is possible to transmit signals at high speed.

Further, as illustrated in FIG. 15A, the ground connection pads 258A are rectangularly shaped to project more toward the jack connector 3A side (in the Y2 side) than the signal connection pads 254A and 256A. Accordingly, when the plug connector 2A and the jack connector 3A are connected, the ground connection pads 258A come into contact (with the circuit board 11A) earlier than the signal connection pads 254A and 256A. This makes it possible to discharge static electricity first, so that it is possible to protect an apparatus system in which the connector unit 1A is mounted.

As described above, according to the jack connector 3A of this embodiment, the conductive layer 114A-2 that electrically connects the ground layer 111A and the ground circuit GC1 may be provided on the counterpart connector (plug connector 2A) side in the ground circuit GC1. Accordingly, it is possible to narrow (reduce) the stub S1 of the transmission path F1. As a result, it is possible to suppress a variation in ground potential even in high-speed transmission, so that it is possible to make ground more effective against high-frequency signals.

According to the plug connector 2A of this embodiment, the conductive layer 214A-1 that electrically connects the ground layer 211A and the ground circuit GC2 may be provided on the counterpart connector (jack connector 3A) side in the ground circuit GC2. Accordingly, it is possible to narrow (reduce) the stub 52 of the transmission path F2. As a result, it is possible to suppress a variation in ground potential even in high-speed transmission, so that it is possible to make ground more effective against high-frequency signals.

Further, according to the jack connector 3A of this embodiment, the conductive layer 114A-3 is further provided in or around part of the contact part C1 of the ground circuit GC1 which part comes into contact with the ground circuit GC2. Accordingly, it is possible to shorten the transmission path between the plug connector 2A and the ground layer 111A. As a result, it is possible to suppress a variation in ground potential even in high-speed transmission, so that it is possible to make ground more effective against high-frequency signals.

Further, according to the plug connector 2A of this embodiment, the conductive layer 214A-2 is further provided in or around the contact part C3 of the ground circuit GC2 which comes into contact with the ground circuit GC1. Accordingly, it is possible to shorten the transmission path between the jack connector 3A and the ground layer 211A. As a result, it is possible to suppress a variation in ground potential even in high-speed transmission, so that it is possible to make ground more effective against high-frequency signals.

Further, according to the jack connector 3A of this embodiment, the conductive layer 114A-3 is provided near the contact part C1 and on the opposite side of the contact part C1 from the plug connector 2A. This allows the transmission direction of the shortest transmission path between the plug connector 2A and the ground layer 111A to be a forward direction (unidirectional), so that it is possible to improve transmission characteristics.

Further, according to the plug connector 2A of this embodiment, the conductive layer 214A-2 is provided near the contact part C3 and on the opposite side of the contact part C3 from the jack connector 3A. This allows the transmission direction of the shortest transmission path between the jack connector 3A and the ground layer 211A to be a forward direction (unidirectional), so that it is possible to improve transmission characteristics.

Further, according to the jack connector 3A of this embodiment, the conductive layer 114A-4 is provided on the external board (daughterboard 5A) side in the ground circuit GC1. This makes it possible to narrow (reduce) the stub S2 of the transmission path F1 on the external board side. As a result, it is possible to suppress a variation in ground potential even in high-speed transmission, so that it is possible to make ground more effective against high-frequency signals.

Further, according to the plug connector 2A of this embodiment, the conductive layer 214A-3 is provided on the external board (backplane 4A) side in the ground circuit GC2. This makes it possible to narrow (reduce) the stub S4 of the transmission path F2 on the external board side. As a result, it is possible to suppress a variation in ground potential even in high-speed transmission, so that it is possible to make ground more effective against high-frequency signals.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present inventions has been described in detail, it should be understood that various changes, substitutions, and alterations could be made hereto without departing from the spirit and scope of the invention.

For example, in the above-described embodiment, the conductive layer (114A, 214A) is provided at four or more points in the ground circuit (GC1, GC2). The present invention, however, is not limited to this, and the conductive layer (114A, 214A) may be provided, for example, at two points, one at the counterpart connector (2A, 3A) side end and one at the external board (5A, 4A) side end, in the ground circuit (GC1, GC2).

Further, in the above-described embodiment, a terminal part (not graphically illustrated) may be provided that projects from the ground layer (111A, 211A) toward the external board (5A, 4A) to electrically connect the ground layer (111A, 211A) to the external board (5A, 4A). In this case, the conductive layer (114A, 214A) may be provided only at the counterpart connector side end in the ground circuit (GC1, GC2).

Further, in the above-described embodiment, when the solder layers (17A, 27A) are caused to melt by application of heat, the leads (12A, 22A) move inside the corresponding guide grooves (132A, 84A) to absorb the (surface) warpage of the external board (5A, 4A) as illustrated in FIGS. 7A through 8B. However, the present invention is not limited to this. For example, the solder layers (17A, 27A) may not be caused to melt when the connector (3A, 2A) is mounted on the external board (5A, 4A).

What is claimed is:

1. A connector to be connected to a counterpart connector, comprising:

a circuit board that includes an insulating layer, a ground layer stacked on one surface of the insulating layer, and a first conductive layer stacked on the other surface of the insulating layer, wherein the first conductive layer includes a signal circuit and a ground circuit; and a second conductive layer electrically connecting the ground circuit and the ground layer, the second conductive layer being provided in or around a contact part which is a portion of the circuit board that comes into contact with a ground circuit of the counterpart connector.

2. The connector as claimed in claim 1, wherein the second conductive layer is provided on a portion of the ground circuit across the contact part from the counterpart connector.

3. The connector as claimed in claim 1, further comprising:

a lead connected to the conductive layer to electrically connect the circuit board to an external board, wherein the second conductive layer is provided on, or close to, a portion of the ground circuit connected to the lead.

4. The connector as claimed in claim 3, wherein the second conductive layer is provided at an end portion of the ground circuit to which the lead is connected.

5. The connector as claimed in claim 1, wherein the second conductive layer is provided at an end portion of the ground circuit that comes into contact with the counterpart connector.

6. The connector as claimed in claim 1, wherein the second conductive layer is provided at an outer edge of the insulating layer.

7. A connector to be connected to a counterpart connector, comprising:

a circuit board in which a ground layer, an insulating layer, and a first conductive layer are stacked, wherein the first conductive layer at least includes a ground circuit, and the ground circuit includes a ground pad to be connected to a ground circuit of the counterpart connector; and a second conductive layer that electrically connects the ground circuit and the ground layer, wherein the second conductive layer is provided in or near a portion of the ground pad which comes into contact with the ground circuit of the counterpart connector.

8. A connector to be connected to a counterpart connector, comprising:

a circuit board in which a ground layer, an insulating layer, and a ground circuit are stacked, wherein the circuit board includes a ground pad to be connected to a ground circuit of the counterpart connector, and a portion of the ground layer is provided in the ground pad; and a second conductive layer provided at an end portion of the ground pad, wherein the second conductive layer electrically connects the ground circuit and the ground layer.

* * * * *